United States Patent [19]

Wadsworth

[11] Patent Number: 4,617,687

[45] Date of Patent: Oct. 21, 1986

[54] VENTILATED TOILET

[76] Inventor: Julian A. Wadsworth, R.R. 2, Box 84, Laurel Hill, Fla. 32567

[21] Appl. No.: 653,596

[22] Filed: Sep. 24, 1984

[51] Int. Cl.[4] ..... E03D 9/04

[52] U.S. Cl. ..... 4/213; 4/217; 4/DIG. 3

[58] Field of Search ..... 4/213, 217, 305–308, 4/DIG. 3

[56] References Cited

U.S. PATENT DOCUMENTS

| | | | |
|---|---|---|---|
| 3,049,722 | 8/1962 | Boggs | 4/213 |
| 3,108,289 | 10/1963 | Smith | 4/217 X |
| 3,295,147 | 1/1967 | Meyer | 4/213 |
| 3,999,225 | 12/1976 | Ables | 4/213 |
| 4,125,906 | 11/1978 | Weiland | 4/213 X |
| 4,196,481 | 4/1980 | Swanda | 4/DIG. 3 |
| 4,251,888 | 2/1981 | Turner | 4/213 |
| 4,304,015 | 12/1981 | Hubatka | 4/308 |

*Primary Examiner*—Henry K. Artis

*Attorney, Agent, or Firm*—L. S. Van Landingham, Jr.

[57] ABSTRACT

A ventilated toilet is disclosed which includes an exhaust fan assembly, electrical connections therefor, and a normally open pneumatically operated switch element, all of which are located remote from the toilet area so that the user is never endangered thereby. An internal passageway is formed within the toilet seat which is in communication with the interior of the toilet bowl by means of a series of spaced holes located in the bottom of the toilet seat. A collapsible bulb is provided beneath each of the two sides of the toilet seat, and each bulb is connected to an air tube that lies within the passageway within the toilet seat. The two air tubes leading from the collapsible bulbs join via a Y-connection into one air tube, which leads to the pneumatically operated switch. When pressure is applied to the toilet seat, the collapsible bulbs are compressed and air is forced under pressure through the air tubes. The increased air pressure trips the aforementioned pneumatically operated switch to the closed position and the fan motor is started thereby. The fan produces a suction that draws odorous air from the toilet bowl into the passageway in the toilet seat via the series of holes, and the odorous air is then drawn through a conduit leading away from the toilet and is discharged. The switch element, exhaust fan assembly and the electrical connections therefor are located sufficiently far from the toilet area so that the user is not endangered thereby. As an additional precaution, all materials of construction between the toilet seat and exhaust fan assembly are non-electrically conductive. Fan noise is avoided by locating the exhaust fan assembly remote from the toilet area, and/or by using effective sound insulation.

30 Claims, 8 Drawing Figures

VENTILATED TOILET

THE BACKGROUND OF THE INVENTION

1. The Field Of The Invention

The present invention relates to ventilated toilets of the type adapted to remove odorous air from the toilet bowl and discharge said air at a remote location. The invention is further concerned with improved apparatus for automatically exhausting odorous gases from the interior of a toilet bowl which includes a pneumatically operated switch for activating an exhaust fan, wherein the switch is activated when pressure is applied to collapsible bulbs located on the bottom surface of the toilet seat.

2. The Prior Art

It is desirable from an aesthetic standpoint to remove, eliminate or neutralize odors produced when a toilet is in use, and heretofore a number of attempts have been made to provide a satisfactory ventilated toilet. It is well known in the prior art to provide a fan assembly that produces a suction to draw away odorous air from a toilet bowl when the toilet is in use. The odorous air may be passed through a conduit and exhausted from the building, or it may be passed through a filter or purifying assembly and recirculated. It is also known in the prior art to provide a passageway in the toilet seat which is in communication with the toilet bowl to draw away air therefrom, as is shown in U.S. Pat. No. 3,790,970.

It is also known to provide a switch for an electrically powered fan assembly so that the fan will operate when needed, and a number of electrical switches have been proposed for this purpose. Early examples include wall mounted switches, which have the disadvantage of requiring manual activation by the user of the toilet. The user often neglects to activate the switch, and in such event, the bathroom remains unventilated It is preferable to provide a switch assembly that will always automatically activate the fan motor each time that the toilet is in use. Automatic switches are disclosed, for example, in U.S. Pat. Nos. 2,172,506 and 1,911,032.

The aforementioned prior art automatic switches are not entirely satisfactory. One problem is that the switches are in close proximity with the toilet bowl, and thus often get wet. Wet switches create an electrical hazard to the user of the toilet, and also tend to short out and render the ventilating system useless. It is therefore desirable to provide an entirely satisfactory automatic switch and exhaust fan assembly that are positioned in a remote location which is sufficiently far away from the toilet area so that all possibility of an electrical hazard is eliminated, and yet may be automatically activated each time that the toilet is in use.

THE SUMMARY OF THE INVENTION

In one important embodiment of the present invention, a ventilated toilet is provided which includes a pneumatically operated switch element positioned in a remote location away from the toilet bowl, and which is activated when pressure is applied to the toilet seat. A collapsible bulb is provided on each side of the bottom of the toilet seat, and each bulb is connected to an air tube that lies within a passageway located within the toilet seat. The air tubes leading from the two collapsible bulbs join via a Y-connection into one air tube, which then leads to a pneumatically operated switch. The switch is normally spring biased to the off position, but when pressure is applied to the toilet seat and the collapsible bulbs are compressed, air is forced through the air tubes. The resultant air pressure trips the switch and maintains the circuit in the closed position until air pressure is reduced by eliminating pressure on the toilet seat When the switch is in the on position, a fan motor is activated. The fan creates a suction that draws air away from the toilet bowl via the passageway in the toilet seat and a series of holes in the toilet seat that communicate with the interior of the toilet bowl. The odorous air is then lead through a conduit whereafter it may be discharged from the building or to any other suitable location The appended claims are incorporated herein by reference and may be referred to for additional embodiments of the invention.

THE BRIEF DESCRIPTION OF THE ACCOMPANYING DRAWINGS

The invention will be described hereinafter in greater particularity with reference to the presently preferred embodiments thereof illustrated in the accompanying drawings, wherein.

Figure 1:
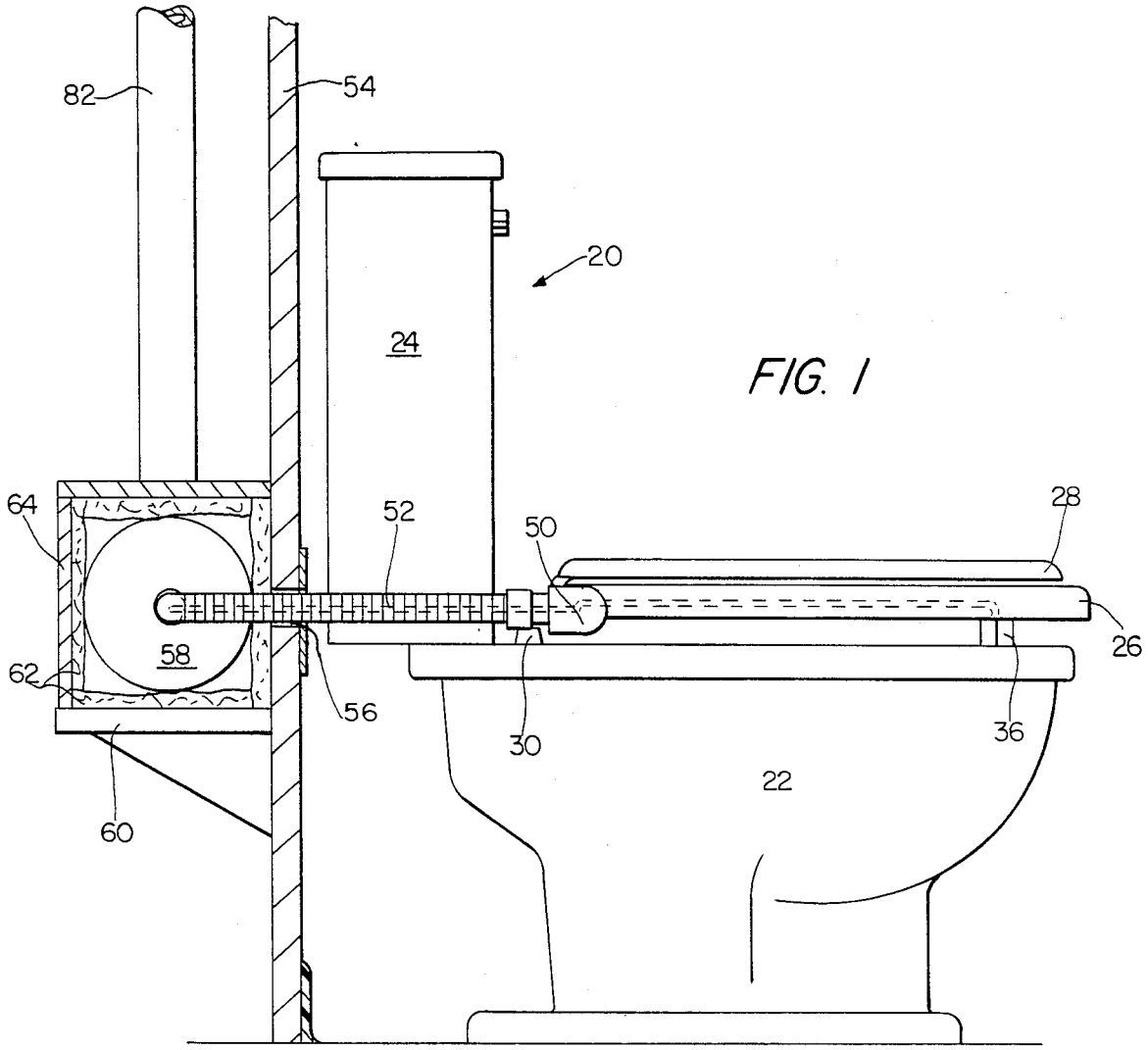
FIG. 1 is a side view in elevation of the improved ventilated toilet of the invention, further illustrating in cross-section the bathroom wall adjacent thereto and associated ventilating apparatus.
Figure 2:
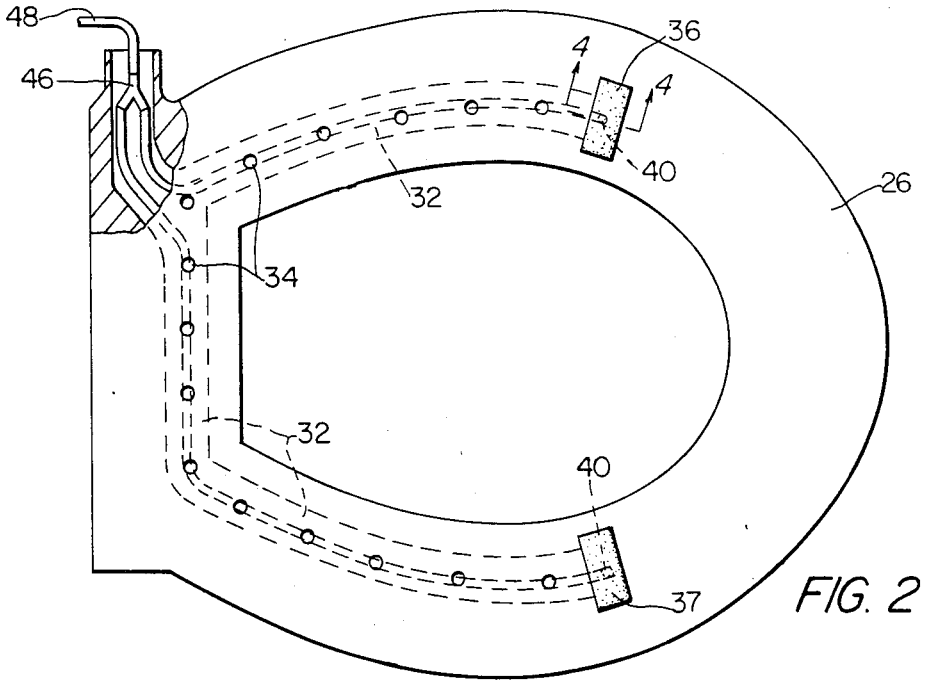
FIG. 2 is a top plan view of one preferred embodiment of the toilet seat used in the apparatus of FIG. 1, with a portion thereof being broken away to illustrate the internal passageway and tubing.
Figure 3:
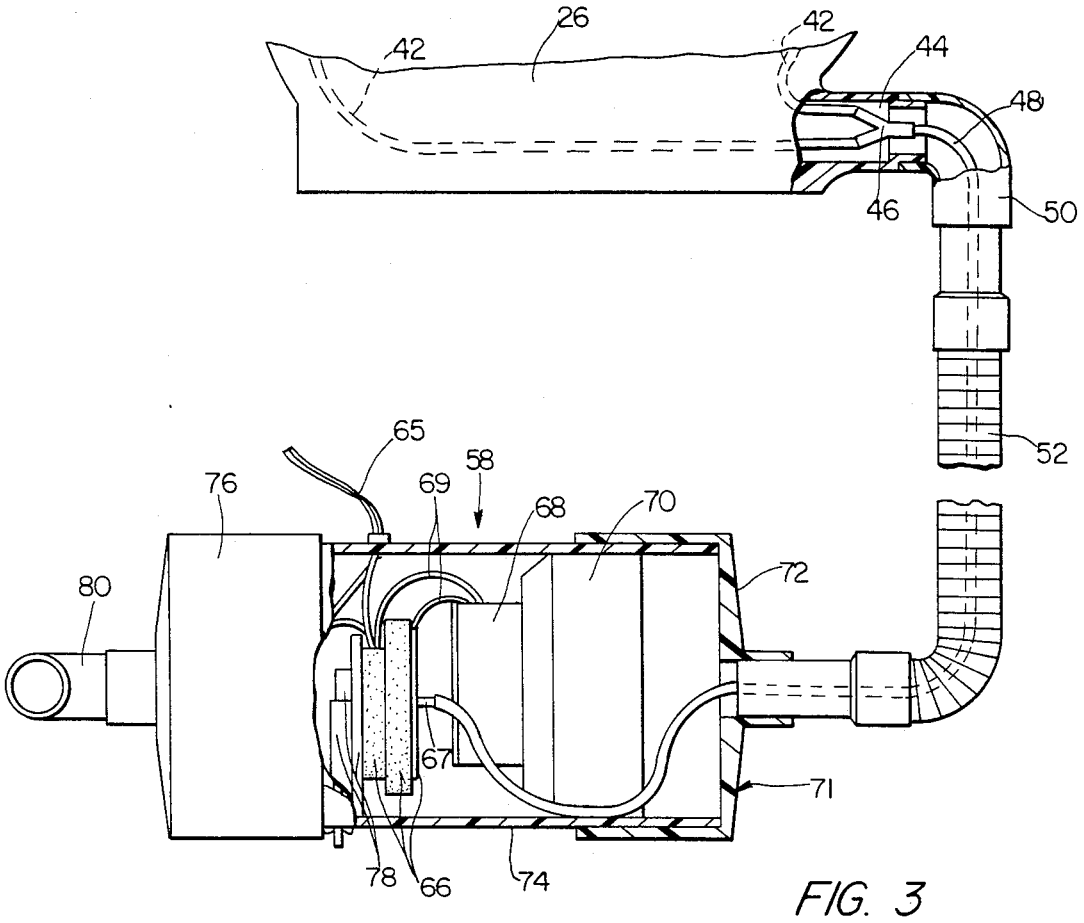
FIG. 3 is a top plan view showing the toilet seat, exhaust conduit and fan assembly of the invention, with portions thereof being broken away to more clearly illustrate features of this assembly.
Figure 4:
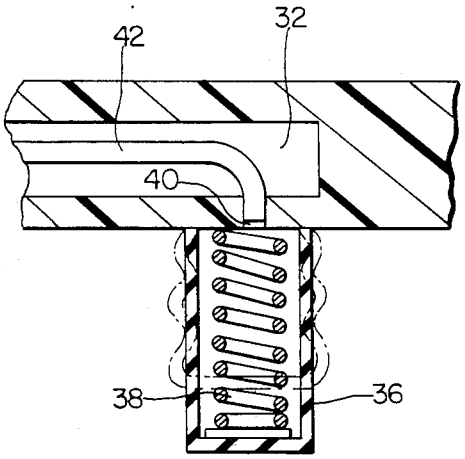
FIG. 4 is a cross-sectional view taken along line 4—4 of FIG. 2 illustrating the collapsible bulb assembly and the internal passageway formed within the toilet seat of FIG. 2.

THE DETAILED DESCRIPTION OF THE INVENTION INCLUDING THE PRESENTLY PREFERRED EMBODIMENTS THEREOF

Referring now to FIGS. 1–4 of the drawings, the toilet 20 includes a toilet bowl 22, water tank 24, toilet seat 26 and toilet lid 28. The toilet lid 28 is hingedly mounted on the toilet seat 26 by means of hinge assembly 30 to enable the toilet seat 26 and toilet bowl 22 to be covered when desired. The toilet seat 26 is attached to the toilet 20 by means of a conventional hinge assembly 30 which allows the toilet seat 26 and toilet lid 28 to be raised or lowered when desired. The toilet seat 26 and toilet lid 28 may be constructed of wood, plastic or any other suitable electrically non-conductive material.

The toilet seat 26 includes a passageway 32 formed therein. In one presently preferred embodiment, the passageway 32 is generally U-shaped and does not extend around the entire length of the toilet seat 26, but it may be lenghtened if desired to encircle the toilet seat 26. A series of holes 34 are formed which lead from the bottom of the toilet seat 26 to the passageway 32. A pair of similar collapsible bulbs 36 and 37 are mounted on the bottom of the toilet seat 26 in an airtight manner. Each of the collapsible bulbs 36 and 37 is normally maintained in an extended position by means of a spring 38. Each collapsible bulb 36 and 37 is attached in airtight relationship to the bottom of the toilet seat 26 under a hole 40 that leads to the passageway 32. An airtight tube 42 is inserted into each of the holes 40 in airtight relationship with the walls of holes 40 so that no air may pass between the walls of holes 40 and the outside walls of the air tubes 42. The air tubes 42 are preferrably made of polyurethane or other suitable plastic or flexible materials, and lead from the hole 40 at each collapsible bulb 36 and 37 through the passageway 32 toward the opening of the passageway 44. Near the opening of the passageway 44, the air tubes 42 are joined to a Y-connection 46 which leads to a single airtight tube 48 which exits the toilet seat 26.

The opening of the passageway 44 is connected to flexible conduit 52 by means of elbow joint 50. The flexible conduit 52 passes through wall 54 via opening 56, and leads to fan assembly 58. The fan assembly 58 is preferably mounted on platform 60 which is adjacent wall 54 and located behind toilet 20. The fan assembly 58 is surrounded by sound insulation 62 within housing 64 to thereby reduce or eliminate fan noise when in use. The fan assembly 58 is comprised of switch element 66, motor assembly 68 and fan blade assembly 70, all of which are held within a generally cylindrical housing 71. The switch element 66 is supported within the housing 71 by bracket assembly 78. The housing 71 consists of housing inlet portion 72, housing central portion 74, and housing outlet portion 76. Flexible conduit 52 connects with housing inlet portion 72 whereupon it terminates. Housing outlet portion 76 leads to exit conduit 82 via elbow joint 80.

Air tube 48 leads from the opening of the passageway 44 through elbow joint 50 and flexible conduit 52 to fan assembly 58. The air tube 48 continues into housing inlet portion 72 and housing central portion 74 and leads to switch element 66. The air tube 48 is attached to connector 67 of switch element 66. An electric cord 65 leads from switch element 66 to a prior art source of electric current, such as a conventional wall electric outlet. When the switch is in the on position, the electric current controlled by switch element 66 is closed and electricity flows to motor assembly 68 via lead wires 69. When the switch 66 is in the off position, the electric circuit is interrupted and no current flows to motor assembly 68. The switch contact element of the switch element 66 is normally spring biased in the off position. However, when the collapsible bulbs 36 and 37 are compressed, as shown in phantom line in FIG. 4, air is forced from the collapsible bulbs 36 and 37 into air tubes 42, through Y-connection 46, and into air tube 48. The bulbs 36 and 37, air tubes 42, Y-connection 46, air tube 48 and switch element 66 form an airtight system, and the increased air pressure in air tubes 42 and 48 upon compressing bulbs 36 and 37 is sufficient to overcome the force of the spring which normally keeps the switch contact element in the off position and the contact element is forced to the on position, as will be described more fully hereinafter in connection with FIG. 8. The circuit is closed, and the electric current passes through lead wires 69 to motor assembly 68, which causes fan blade assembly 70 to rotate, thereby drawing air from toilet bowl 22. When the collapsible bulbs 36 and 37 are not compressed and are in their fully extended position, the force of the spring biasing the switch contact element is greater than the air pressure in air tubes 42 and 48, and the switch contact element returns to the off position. The electric circuit is interrupted thereby, and no current passes to motor assembly 68 and fan blade assembly 70 does not rotate or draw air from toilet bowl 22.

When pressure is applied to the collapsible bulbs 36 and 37, as for example when a person sits on toilet seat 26, the bulbs 36 and 37 and springs 38 are compressed into a smaller volume as is shown in phantom line, and the resulting increased air pressure in the airtight system including air tubes 42 and 48 causes the switch element 66 to move to the on position and thereby complete the electric circuit, and thereupon the the fan blade assembly 70 rotates. The rotating fan blade assembly 70 produces a suction that draws air toward the fan blade assembly 70. Odorous air is drawn from toilet bowl 22 through holes 34 and into passageway 32 within the toilet seat 26. This odorous air is drawn through the opening of the passageway 44, elbow joint 50 and flexible conduit 52. The odorous air is then passed through the housing inlet portion 72, whereupon it passes through the fan blade assembly 70. The odorous air then passes through the housing central portion 74 and housing outlet portion 76, and travels through elbow joint 80. The odorous air then passes into exit conduit 82 and is discharged from the building, or is disposed of in some other suitable manner.

Figure 5:
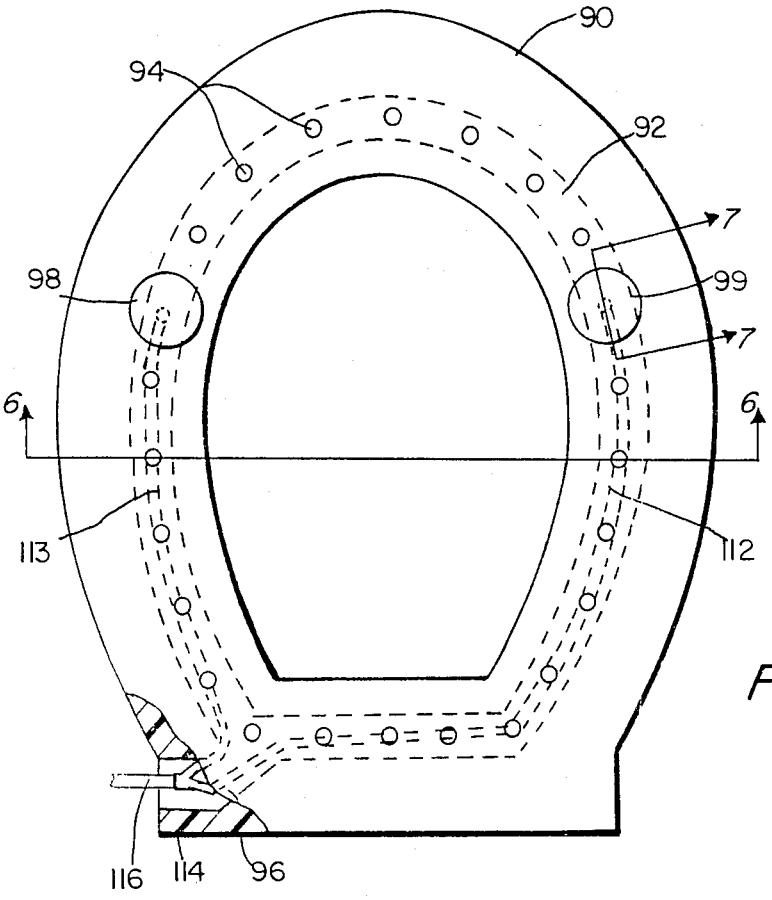
FIG. 5 is a top plan view of a second preferred embodiment of the toilet seat used in the apparatus of FIG. 1, with a portion thereof being broken away to illustrate the internal passageway and tubing.
Figure 6:
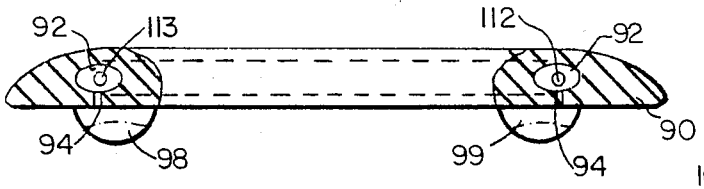
FIG. 6 is a cross-sectional view taken along line 6—6 of FIG. 5 illustrating the internal characteristics of the toilet seat of FIG. 5.
Figure 7:
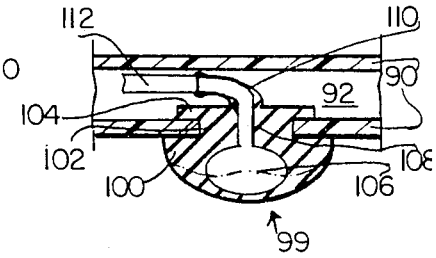
FIG. 7 is a cross-sectional view taken along line 7—7 of FIG. 5 illustrating the alternative collapsible bulb assembly and internal passageway of the toilet seat of FIG. 5.

Referring now to FIGS. 5, 6 and 7 of the drawings, a further presently preferred modification of the collapsible bulbs 36 and 37 and passageway 32 in the toilet seat 26 of FIGS. 1–4 is shown, with the remaining structure previously described for FIGS. 1–4 remaining unchanged. A toilet seat 90 of the usual size and configuration is provided with a passageway 92 extending around the entirety of the toilet seat 90. The passageway 92 is centrally formed within the toilet seat 90 and preferably has a generally elliptical shape in cross-section. A series of spaced holes 94 are provided which extend around the entirety of the toilet seat 90 directly beneath the passageway 92. These holes 94 pass through the underside of the toilet seat 90 and extend therethrough to the passageway 92 formed in the toilet seat 90, thereby allowing gases to flow into the passageway 92. Extending approximately centrally through the side of toilet seat 90 is a second passageway 96 which communicates with the passageway 92, thereby allowing gases within the passageway 92 to flow through passageway 96 and out through the side of the toilet seat 90.

Attached to the underside of toilet seat 90 are similar collapsible bulbs 98 and 99 which are preferably of a unitary construction and made of rubber, flexible plastic, or other suitable electrically non-conductive flexible material. The collapsible bulb 99 is shown in cross-section in FIG. 7, and includes a semispherical outer portion 100 visible from the underside of the toilet seat 90 and a mounting portion 102 including flange 104. A hole through the underside of toilet seat 90 and passing through passageway 92 is provided which is approximately the same diameter as mounting portion 102 of collapsible bulb 99. The mounting portion 102 including flange 104 is forced through the aforesaid hole and into the desired position. Flange 104 maintains the collapsible bulb 99 in the desired position. Centrally disposed within the generally semi-spherical outer portion 100 is a generally ellipsoidal air space 106 of any desired size capable of operating a pneumatic switch such as described more fully hereinafter in FIG. 8. A small passageway 108 extending from the air space 106 centrally through the mounting portion 102 and flange portion 104 is provided. A hollow curved tube mounting extension 110 extends from small passageway 108 and curves toward the passageway 96. The tube mounting extension 110 includes a flanged area at the end thereof adapted for holding a plastic tube of similar diameter. As is shown in phantom line, the collapsible bulbs 98 and 99 are sufficiently flexible so as to be compressed when sufficient pressure is applied to the bottom of the semispherical outer portions 100. The contents of air space 106 are forced from the air space 106, through small passageway 108 and hollow tube mounting extension 110, and then out of the bulb 99 when sufficient pressure is applied to the outer portion 100. The bulb 98 is constructed and operates in a similar fashion. When pressure is released on bulbs 98 and 99, the outer portions 100 regain their normal shape shown in solid line without the need for springs 38 or other similar means.

An air tube 112 is attached to the flanged area at the end of tube mounting extension 110 and extends through passageway 92 into passageway 96. A similar air tube 113 is connected to collapsible bulb 98 and extends through passageway 92 into passageway 96. The air tubes 112 and 113 are joined to Y-connection 114 which leads to a single air tube 116, which exits from the toilet seat 90. The air tube 116 extends to the switch element 66 in the manner previously described and likewise operates the fan switch and fan assembly 70 as previously described to create suction and withdraw odorous gases from the toilet bowl 22 when in use. It is understood that the bulbs 98 and 99, the air tubes 112 and 113, the Y-connection 114, the air tube 116 and the switch element 66 form an airtight system whereby upon compressing the outer portions 100 of bulbs 98 and 99, the air pressure is increased within the air tubes 112, 113 and 116 sufficiently to force the switch element to the on position and thereby complete the electric circuit and cause current to flow therein and operate fan assembly 70, as more fully described in connection with FIG. 8.

Figure 8:
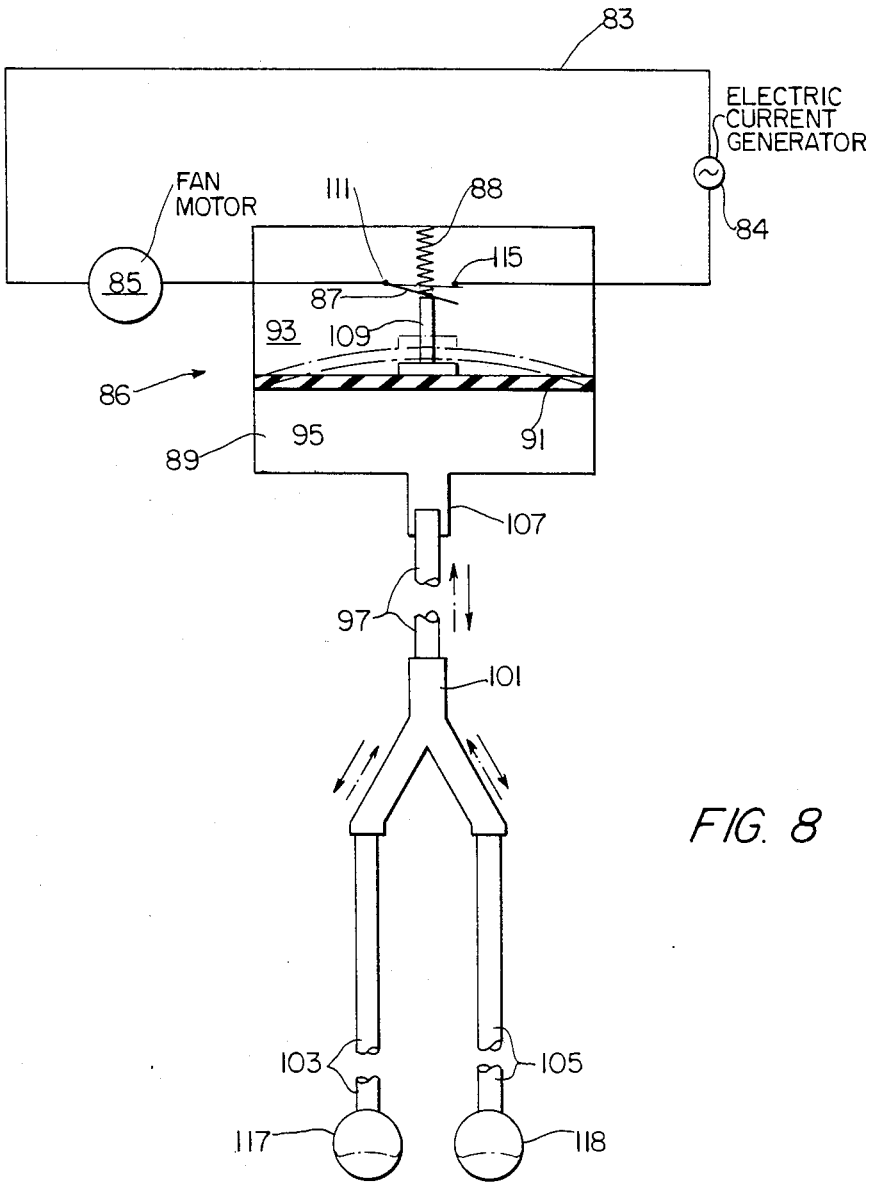
FIG. 8 is a schematic representation of the preferred switch element of the invention showing the switch in the off position, and in phantom line showing the switch in the on position.

FIG. 8 of the drawings schematically illustrates one presently preferred arrangement of the electric circuitry and related apparatus previously described in connection with the electric cord 65, switch element 66, electric motor assembly 68 and lead wires 69 of FIGS. 1–4. Referring now to FIG. 8, the electric circuit 83 includes an electric current generator 84, fan motor 85 and a pneumatic switch assembly 86. The switch assembly 86 is capable of interrupting and/or completing the electric circuit 83, and thereby controls the flow of current to fan motor 85 and the operation thereof in response to fluid pressure acting thereon. The switch assembly 86 includes a switch 87 biased by means of spring 88 to the normally open position shown in solid line, whereby the electric circuit 83 is normally interrupted and current does not flow to fan motor 85. The switch assembly 86 also includes (1) a fluidtight housing 89, (2) a flexible diaphragm 91 mounted at an intermediate point across the housing 89 and in fluidtight relationship with the internal wall thereof whereby the housing 89 is divided into an internal zone 93 and an external zone 95 having variable capacities which are dependent upon the pressure of the fluid in tube 97, Y-connection 101, tubes 103 and 105, and compressible bulbs 117 and 118, (3) a fluid inlet 107 in communication with the external zone 95, and (4) a plunger rod 109 which is attached to the internal surface of diaphragm 91 and extends inward therefrom into contact with the inner side of switch 87 at a point remote from the flexible electrical connection of switch 87 to contact point 111, and also at a point remote from electrical contact point 115 when switch 87 is in the closed position shown in phantom line. As will be recognized from the earlier discussion of FIGS. 1–7, the switch assembly 86 including flexible diaphragm 91 and external zone 95, tubes 97, 103 and 105, Y-connection 101, and collapsible blubs 117 and 118 form a fluidtight system in which the pressure of the confined fluid present therein may be varied by applying or not applying pressure to compressible bulbs 117 and 118. When pressure is not applied to bulbs 117 and 118, then the various components of the system are positioned as shown in solid line and the switch 87 is in the open position, the electric circuit is interrupted and current does not flow to fan motor 85, the fan motor does not operate and odorous air is not exhausted from toilet bowl 22. However, when pressure is applied to the bulbs 117 and 118 they are compressed to the positions shown in phahtom line, pressure is thereby applied to the confined fluid and it flows in the direction of the arrows shown in phantom line, the diaphragm 91, plunger rod 109 and switch 87 are moved to the positions shown in phantom line, and the switch 87 is moved to the closed position, the electric circuit is completed, electric current flows to the fan motor, and odorous air is exhausted from the toilet bowl 22. When the pressure is released on bulbs 117 and 118, then the pressure in the components of the system returns to its initial level, the fluid flows back to the bulbs 117 and 118 in the direction of the arrows in solid line, and the diaphragm 91, plunger rod 109 and switch 87 return to their initial open position shown in solid line. Usually, the confined fluid in the system is air, but other suitable gases or mixtures of gases may be used, and especially non-explosive gases, such as nitrogen, carbon dioxide, helium, neon and mixtures thereof. It is also possible to use suitable liquid fluids such as water, ethyl, methyl and other lower or normally liquid alcohols, or other suitable normally liquid organic substances, and admixtures thereof.

It is apparent from the foregoing discussion that all electrical connections required to operate the fan assembly 58 are located far from the toilet 20 and the user is never endangered thereby. As an additional precaution, all materials used in constructing the improved ventilated toilet of the invention that are located between the toilet seat 26 and the fan assembly 58 are electrically non-conductive materials, such as wood or plastic. The improved construction of the invention further allows the fan assembly 58 to be positioned at a location sufficiently remote from the toilet 20 so that distracting fan noise is avoided and sound insulation may be used to further reduce or eliminate all fan noise.

While certain preferred embodiments of the invention have been specifically described herein, it is understood that modifications may be made therein that are within the spirit of the invention. For example, an air filtering device may be provided which allows the odorous air to be filtered, purified and reciculated. The filtering and purifying device may be located within or outside of the bathroom, and it may allow the air to be recirculated within the bathroom or within any other desired room. This eliminates the need for an exit conduit that discharges odorous air from the building. Also, the air tubes need not necessarily go through the conduit or passageway as is shown in the presently preferred embodiment of FIGS. 1–7. In still another embodiment, it is possible to provide sufficient pressure to activate the pneumatic fan switch by means of a squeeze bulb or the like which may be held in the hand or operated with the foot, and compressed from time to time or continuously when it is desired to operate the exhaust fan. Still other modifications will be apparent to those skilled in this art.

The foregoing detailed description and the accompanying drawings are for purposes of illustration only, and are not intended as being limited to the spirit or scope of the appended claims.

I claim:

1. A ventilated toilet comprising:

(a) a toilet comprising a toilet bowl and a toilet seat, the toilet seat being mounted on the toilet above the toilet bowl;

(b) an electric exhaust fan assembly comprising an exhaust fan, an electric motor for driving the exhaust fan, and electric lead means for connecting the exhaust fan assembly to a source of electricity;

(c) a source of electricity for operating the said electric exhaust fan assembly, the said electric lead means being connected to said source of electricty to thereby provide an electric circuit and power for operating the said electric exhaust fan assembly including the said electric motor and thereby driving the exhaust fan;

(d) switching means for activating and deactivating said electric exhaust fan assembly comprising a switch positioned in said electric circuit which is normally biased to the open circuit position by biasing means which applies force thereto;

(e) means for operating said switching means whereby the said switch is moved from the normally open circuit position to the closed circuit position and thereafter allowed to return to the normally open circuit position, said operating means comprising first conduit means for carrying fluid under pressure, fluid pressurizing means for intermittently forcing fluid into said first conduit means, and means for applying force against said switch in a direction to overcome the force applied by said biasing means in response to fluid being forced under pressure into said first conduit means by said fulid pressurizing means whereby sufficient force is exerted against said switch to overcome the bias to the open circuit position and to thereby move the said switch to the closed circuit position and operate the said electric exhaust fan assembly, said means for applying pressure against the switch being rendered ineffective when the fluid pressurizing means is likewise rendered ineffective intermittently, said fluid pressurizing means including a plurality of spaced fluid pressurizing elements, said plurality of spaced fluid pressurizing elements collectively co-operating to intermittently force a variable volume of pressurized fluid into said first condiut means in response to the amount of pressure applied thereto during normal use of the toilet, said variable volume of pressurized fluid varying directly with the amount of said applied pressure and being at least sufficient to operate said switching means during normal use of the toilet, and siad plurality of fluid pressurizing elements being capable of collectively co-operating to intermittently force a substantially greater volume of pressurized fluid into said first conduit means than is normally required to operate said switching means upon the application of sufficient pressure thereto; and (f) second conduit means for withdrawing gases from the interior of a toilet bowl and discharging the exhausted gases at a location remote therefrom, said second conduit means including a first end portion thereof in communication with the gases in the interior of the toilet bowl through which the said gases may be exhausted from the toilet bowl by the said electric exhaust fan assembly, and the said second conduit means also including a conduit portion in communication with the said electric exhaust fan assembly at a point remote from the first end portion whereby when the said switch is in the closed circuit position the electric exhaust fan assembly is activated and gases are exhausted from the toilet bowl, passed through the first end portion of the said second conduit means to the electric exhaust fan assembly and then discharges at a location remote from the toilet bowl.

2. The ventilated toilet of claim 1 wherein the said electric fan assembly is positioned within the said second conduit means at a point remote from the said first end portion to thereby create suction within the said first end portion when the said switch is in the closed circuit position and thereby withdraw gases from the toilet bowl.

3. The ventilated toilet of claim 1 wherein the said toilet seat has a passageway formed within the toilet seat and a series of spaced openings extending through the underside of the toilet seat and into communication with the said passageway, whereby the said series of openings are in communication with the gases in the interior of the toilet bowl and said second conduit means is in communication with said passageway.

4. The ventilated toilet of claim 1 wherein the said fluid pressurizing means includes at least one compressible bulb located under the said toilet seat, whereby the bulb is automatically compressed by pressure applied to the toilet seat while the toilet is in use and the said exhaust fan assembly is activated and gases are exhausted from the interior of the toilet bowl.

5. The ventilated toilet of claim 4 wherein the said compressible bulb is attached in airtight relationship to the underside of the toilet seat.

6. The ventilated toilet of claim 5 wherein the said toilet seat has a passageway formed therein and the said first conduit means extends through the said passageway and communicates in airtight relationship with the interior of said compressible bulb.

7. The ventilated toilet of claim 6 wherein the said compressible bulb includes flexible closed outer walls having an open top portion, the said open top portion being secured to the underside of said toilet seat in airtight relationship, the toilet seat has an opening formed therein which extends between the said passageway and its undersurface, and the said first conduit means is in communication with the interior of the said bulb and the wall of the first conduit means is in airtight relationship with the wall of the said opening.

8. The ventilated toilet of claim 7 wherein a spring is provided in the said compressible bulb, said spring comprising a first terminal end resting against the underside of the toilet seat and a second terminal end resting against the internal surface of the bottom wall of the compressible bulb.

9. The ventilated toilet of claim 7 wherein said compressible bulb, said toilet seat, said first conduit means and said second conduit means are constructed of electrically non-conductive materials.

10. The ventilated toilet of claim 6 wherein the said compressible bulb includes an outer portion extending beneath the toilet seat comprised of a flexible wall surrounding an interior air space, a mounting portion including a flange adapted to be mounted within an opening of approximately the same diameter as the said mounting portion which extends between the said passageway formed in the toilet seat and the underside of the toilet seat, said mounting portion and flange having a passageway extending therethrough which is in communication with said interior air space, and a tubular mounting extension in communication with said passageway that is adapted to mate with the end of said first conduit means which extends through the said passageway formed in the toilet seat.

11. The ventilated toilet of claim 10 wherein the said outer portion is generally semi-spherical.

12. The ventilated toilet of claim 10 wherein the said tubular mounting extension is curved and includes a flanged area at the end thereof which maintains a tight frictional relationship with said first conduit means which extends through the said passageway formed in the toilet seat.

13. The ventilated toilet of claim 10 wherein the said compressible bulb is of unitary construction

14. The ventilated toilet of claim 10 wherein said compressible bulb, said toilet seat, said first conduit means and said second conduit means are constructed of eletrically non-conductive material.

15. The ventilated toilet of claim 6 wherein said conduit means is in communication with said passageway formed within said toilet seat, a series of spaced openings extending through the underside of the toilet seat to the said passageway is provided, and said first conduit means passes through said second conduit means and terminates at the said switching means.

16. Apparatus for exhausting gases from the interior of a tiolet bowl while the toilet is the use comprising:

(a) an electric exhaust fan assembly comprising an exhaust fan, an electric motor for driving the exhaust fan, and electric lead means for connecting the exhaust fan assembly to a source of electricity to thereby provide electric power for operating the said electric motor and thereby driving the exhaust fan;

(b) switching means for activating and deactivating said electric exhaust fan assembly when said electric leads are connected to a source of electricity comprising a switch positioned in the resulting electric circuit which is normally biased to the open circuit position by biasing means which applies force thereto;

(c) means for operating said switching means whereby the said switch is moved from the normally open circuit position to the closed circuit position and thereafter allowed to return to the normally open circuit position, said operating means comprising first conduit means for carrying fluid under pressure, fluid pressurizing means for intermittently forcing fluid into said first conduit means, and means for applying force against said switch in a direction to overcome the force applied by said biasing means in response to fluid being forced under pressure into said first conduit means by said fluid pressurizing means whereby sufficient force is exerted against said switch to overcome the bias to the open circuit position and to thereby move the said switch to the closed circuit positon and operate the said electric exhaust fan assembly, said means for applying pressure against the switch being rendered ineffective when the fluid pressurizing means is likewise rendered ineffective intermittently, said fluid pressurizing means including a plurality of spaced fluid pressurizing elements, said plurality of spaced fluid pressurizing elements collectively co-operating to intermittently force a variable volume of pressurized fluid into said first conduit means in response to the amount of pressure applied thereto during normal use of the toilet, said variable volume of pressurized fluid varying directly with the amount of said applied pressure and being at least sufficient to operate said switching means during normal use to the toilet, and said plurality of fluid pressurizing elements being capable to collectively co-operating to intermittently force a substantially greater volume of pressurized fluid into said first conduit means than is normally required to operate said switching means upon the application of sufficient pressure thereto; and (d) second conduit means for withdrawing gases from the interior of a toilet bowl and discharging the exhausted gases at a location remote therefrom, said second conduit means including a first end portion thereof in communication with the gases in the interior of the toilet bowl through which the said gases may be echausted from the toilet bowl by the said electric exhaust fan assembly, and the said second conduit means also including a conduit portion in communication with the said electric exhaust fan assembly at a point remote from the first end portion whereby when the said switch is in the closed circuit position the electric exhaust fan assembly is activated and gases are exhausted from the toilet bowl, passed through the first end portion of the said second conduit means to the electric exhaust fan assembly and then discharged at a location remote from the toilet bowl.

17. The apparatus of claim 16 wherein the said electric fan assembly is positioned within the said second conduit means at a point remote from the said first end portion to thereby create suction within the said first end portion when the said switch is in the closed circuit position and thereby withdraw gases from the toilet bowl.

18. The apparatus of claim 16 wherein the said toilet seat has a passageway formed within the toilet seat and a series of spaced openings extending through the underside of the toilet seat and into communication with the said passageway, whereby the said series of openings are in communication with the gases in the interior of the toilet bowl and said second conduit means is in communication with said passageway.

19. The apparatus of claim 16 wherein the said fluid pressurizing means includes at least one compressible bulb located under the said toilet seat, whereby the bulb is automatically compressed by pressure applied to the toilet seat while the toilet is in use and the said exhaust fan assembly is activated and gases are exhausted from the interior of the toilet bowl.

20. The apparatus of claim 19 wherein the said compressible bulb is attached in airtight relationship to the underside of the toilet seat.

21. The apparatus of claim 20 wherein the said toilet seat has a passageway formed therein and the said first conduit means extends through the said passageway and communicates in airtight relationship with the interior of said compressible bulb.

22. The apparatus of claim 21 wherein the said compressible bulb includes flexible closed outer walls having an open top portion, the said open top portion being secured to the underside of said toilet seat in airtight relationship, the toilet seat has an opening formed therein which extends between the said passageway and its undersurface, and the said first conduit means is in communication with the interior of the said bulb and the wall of the first conduit means is in airtight relationship with the wall of the said opening.

23. The apparatus of claim 22 wherein a spring is provided in the said compressible bulb, said spring comprising a first terminal end resting against the underside of the toilet seat and a second terminal end resting against the internal surface of the bottom wall of the compressible bulb.

24. The apparatus of claim 22 wherein said compressible bulb, said toilet seat, said first conduit means and said second conduit means are constructed of electrically non-conductive materials.

25. The apparatus of claim 20 wherein the said compressible bulb includes an outer portion extending beneath the toilet seat comprised of a flexible wall surrounding an interior air space, a mounting portion including a flange adapted to be mounted within an opening of approximately the same diameter as the said mounting portion which extends between the said passageway formed in the toilet seat and the underside of the toilet seat, said mounting portion and flange having a passageway extending therethrough which is in communication with said interior air space, and a tubular mounting extension in communication with said passageway that is adapted to mate with the end of said first conduit means which extends through the said passageway formed in the toilet seat.

26. The apparatus of claim 25 wherein the said outer portion is generally semi-spherical.

27. The apparatus of claim 25 wherein the said tubular mounting extension is curved and includes a flanged area at the end thereof which maintains a tight frictional relationship with said first conduit means which extends through the said passageway formed in the toilet seat.

28. The apparatus of claim 25 wherein the said compressible bulb is of unitary construction.

29. The apparatus of claim 25 wherein said compressible bulb, said toilet seat, said first conduit means and said second conduit means are constructed of eletrically non-conductive material.

30. The apparatus of claim 21 wherein said conduit means is in communication with said passageway formed within said toilet seat, a series of spaced openings extending through the underside of the toilet seat to the said passageway is provided, and said first conduit means passes through said second conduit means and terminates at the said switching means.

* * * * *